United States Patent [19]

Duftler

[11] Patent Number: 4,476,167

[45] Date of Patent: Oct. 9, 1984

[54] POMPON ARTICLES OF MANUFACTURE FOR PACKAGING DECORATION AND STATIONERY

[76] Inventor: Leon Duftler, c/o Duftler & Sons, Inc., 568-578 Broadway, New York, N.Y. 10012

[21] Appl. No.: 395,348

[22] Filed: Jul. 6, 1982

[51] Int. Cl.[3] ..... D04D 7/06

[52] U.S. Cl. ..... 428/4; 28/147; D33/32 R

[58] Field of Search ..... 428/4; 28/147; D33/32 E, 32 R; 229/74

[56] References Cited

U.S. PATENT DOCUMENTS

| | | | |
|---|---|---|---|
| 1,395,033 | 10/1921 | Bowers | 428/4 |
| 1,657,744 | 1/1928 | Durkee | 428/4 |
| 2,832,967 | 5/1958 | Sobel | 428/4 X |
| 3,174,886 | 3/1965 | Miscovich | 428/4 X |
| 3,922,407 | 11/1975 | Nimmo, Jr. et al. | 428/5 |
| 4,055,858 | 11/1977 | Traenkle | 428/4 X |

*Primary Examiner*—Henry F. Epstein
*Attorney, Agent, or Firm*—Bauer & Amer

[57] ABSTRACT

Pompons manufactured into an article having noteworthy utility as packaging decoration in which work-in-process connected pompons are stapled in a criss-crossed relation to an adhesively-backed cardboard substrate to contribute an enhanced appearance to any package to which it is adhesively secured; the referred to appearance avoiding being marred by visible detection of either the staple or the substrate due to the effective masking thereof by the pompons.

2 Claims, 12 Drawing Figures

POMPON ARTICLES OF MANUFACTURE FOR PACKAGING DECORATION AND STATIONERY

The present invention relates to gift wrapping decoration, and more particularly to pompons embodied in articles of manufacture having noteworthy utility as attached decoration for gift boxes or the like.

The above referred to pompons are of the type usually used to decorate lamp shades, knit hats, etc., and now being able to be effectively used as gift box or packaging decoration, in place of, or in addition to, ribbons, wrapping paper, or the like now widely being used for this purpose.

Underlying the present invention is the recognition that the fluffy, spherical shape or configuration which characterizes a pompon, can effectively be used to mask structural features and components for completing the attachment thereof to the gift box which features and components, if not hidden or masked, would detract from the appearance that the pompons are intended to enhance. The embodiment of the pompons in the resulting decoration product is also achieved without increasing manufacturing costs, thus providing an economically, readily mass-produced item.

Broadly, it is an object to provide cotton or other similar construction material pompons, heretofore traditionally used as decoration for more expensive products, but now feasible to be used as inexpensive gift box decoration attachments. More particularly, it is an object to utilize to advantage the economic, mass production of pompons such that with slight and readily applied modifications thereto, the pompons heretofore used for decoration on clothing and such relatively expensive products can now be used as decoration on the boxes or packaging being used for these products.

A pompon article of manufacture for package decoration demonstrating objects and advantages of the present invention includes two work-in-process pompon embodiments, each such embodiment consisting of a pair of pompons interconnected by a core of yarns extending therebetween. The cores of the embodiments just described are placed in criss-crossed relation and a staple then used to attach same to an adhesively-backed cardboard substrate. In practice, the movement of the staple into position causes corresponding closing movement in the pompons towards each other and thus over the staple to thereby mask the staple and substrate from view.

The above brief description, as well as further objects, features and advantages of the present invention, will be more fully appreciated by reference to the following detailed description of presently preferred, but nonetheless illustrative embodiments in accordance with the present invention, when taken in conjunction with the accompamying drawings.

BRIEF DESCRIPTION OF THE DRAWINGS

FIG. 1 illustrating a work-in-process grouping of lengths of yarn in a cylindrical core-like arrangement incident to receiving a pair of staples placed inwardly at the opposite ends thereof;

FIG. 2 illustrates the core of yarns with said staples free ends of the yarns are processed into pompons;

FIG. 3, more particularly, illustrates the completion adjacent one end of the yarns of the ends thereof into what is conventionally known as a pompon;

FIG. 4 illustrates the conventional technique of severing the work-in-process configuration into two pompons; and FIG. 5 is a perspective view illustrating the manner in which the separated pompons are traditionally used as decoration for a product.

The remaining FIGS. 6–12 illustrate a modification in the making and use of pompons which constitutes the within invention. More particularly, FIG. 6 illustrates in a perspective exploded view the manner in which work-in-process pompons in criss-crossed relation are integrated into a first embodiment of a pompon article of manufacture according to the present invention;

FIG. 7 is a plan view of the embodiment of FIG. 6 in its assembled condition, illustrating structural details thereof;

FIG. 8 is a side elevational view, in section taken along line 8—8 of FIG. 7, showing further structural details;

FIG. 9 is a bottom view as seen in the direction of the arrows 9—9 of FIG. 8;

FIGS. 10 and 11 illustrate another embodiment of a pompon article of manufacture according to the present invention. More particularly, FIG. 10 is a perspective exploded view, similar to FIG. 6, but illustrating the use of a ribbon to further enhance the appearance of the resulting product; and FIG. 11 is a perspective view illustrating said second embodiment in its assembled condition.

Remaining FIG. 12 illustrates the manner in which the pompon article of manufacture according to the present invention is used for packaging decoration.

Figure 1:
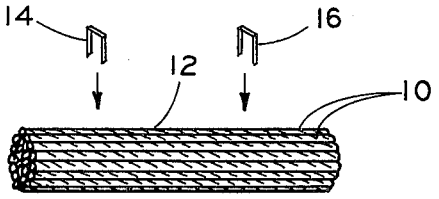
Fig. 1 PRIOR ART
FIGS. 1–5 illustrate the prior art technology related to the making and use of pompons as decoration, to which technology the pompon embodiments of remaining
Figure 2:
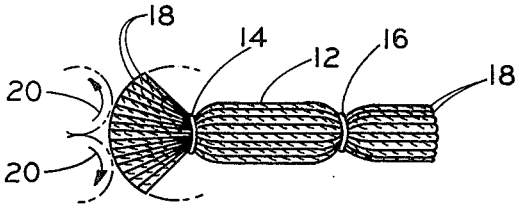
Fig. 2 PRIOR ART

The inventive novelty of the embodiments of the pompon articles of manufacture of the present invention contemplate a non-obvious modification of a currently widely used method of making pompons. Thus, it is helpful as background, to refer to said prior art method of making pompons as illustrated in FIGS. 1–4. More particularly, an initial step for a work-in-process prior art pompon contemplates, as best illustrated in FIG. 1, the grouping of lengths of yarn, individually and collectively designated 10, into a cylindrical corelike configuration, more particularly designated 12. Next, staples 14, 16 are appropriately applied to the core 12 at locations inwardly of the opposite ends in clenched or engaged relation about the core 12. Thus, the work-in-process embodiment as illustrated in FIG. 2 consists of staples 14 and 16 firmly engaged about the lengths of yarn with the free ends of the yarns, more particularly individually and collectively designated 18 in FIG. 2, extending laterally of the staples 14 and 16 and thus advantageously modified into what is commonly known as a pompon construction. Between the staples 14 and 16 the yarns provide a connecting core 12 which is significant to the within invention, as will be subsequently explained.

Figure 3:
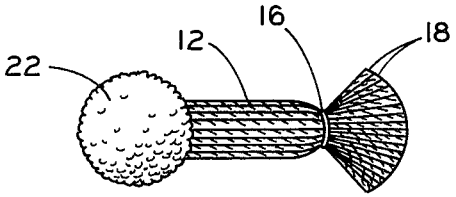
Fig. 3 PRIOR ART

By progressive examination of FIGS. 2 and 3 it should be readily appreciated that the prior art technique contemplates contacting of the yarn ends 18 with appropriate machinery which is effective to brush the yarn free ends in the directions 20 such that said free ends form a fluffy, generally cylindrical shape, illustrated and designated 22 in FIG. 3, and which shape will be understood to constitute what is commonly referred to as a pompon.

Figure 4:
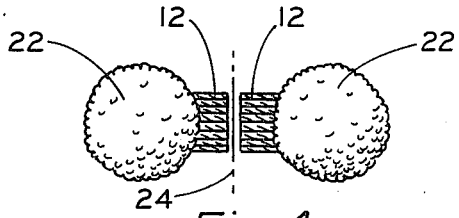
Fig. 4 PRIOR ART
Figure 5:
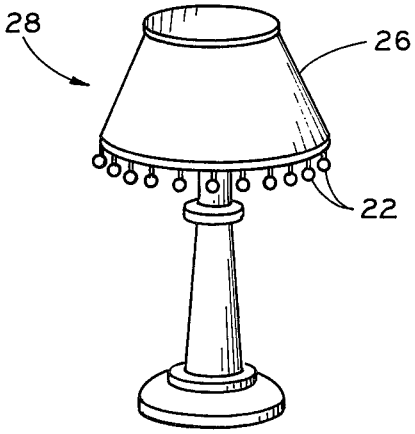
Fig. 5 PRIOR ART

Completing the within described prior art procedure is the further processing of the work-in-process configuration into the form illustrated in FIG. 4 wherein the connecting core 12 is cut or appropriately severed at a medial location, as at 24, to thereby form two separated pompons 22. Illustrative of one decorative end use for the pompons 22 is the sewing attachment thereof about the lower edge of a shade 26 of a lamp 28, as shown in FIG. 5.

Figure 6:
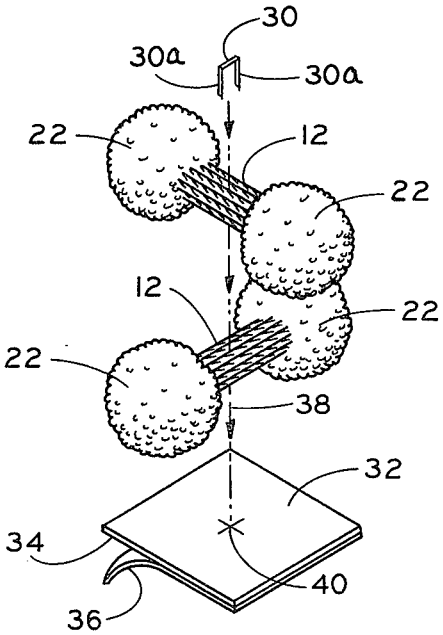
FIGS. 6–12 are an inventive contribution. More particularly, progressive examination of FIGS. 1–4 is intended to illustrate the conventional way of making pompons.

Reference should now be made to FIG. 6 illustrating the departure from the prior art method of making pompons which is contemplated in accordance with the present invention. More particularly, instead of separating the work-in-process configuration into two pompons 22 as illustrated in FIG. 4, two such configurations, still within the connecting core 12 for each intact, are arranged in criss-crossing relation, all as is clearly illustrated in FIG. 6. In addition, said criss-crossed cores 12 are attached by a staple 30 to a cardboard substrate 32 having an adhesive surface 34 temporarily protected by a cover 36 that is readily peeled away incident to using the adhesive surface 34 for attachment of the resulting pompon articles of manufacture. Still referring to FIG. 6, it will be understood that when the staple 30 is applied with a staple gun or similar instrument that it is urged through movement, as along the path 38, and projected through the substrate 32, as at the central location 40, and the free ends 30*a* thereof then folded under the substrate 32, in a conventional manner, in order to complete attachment of the criss-crossed pompons 22 to the substrate 32. As will be soon explained, the driving or projection of the staple 30 as along the path 38 firmly through the substrate 32 causes a crimp in the cores 12 and correspondingly causes the pompons 22 to close in movement towards each other above the connecting leg of the staple 30, and this effectively masks the staple from view.

Figure 7:
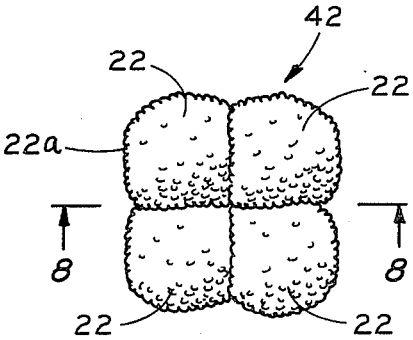

The assembled pompon articles of manufacture of FIG. 6 is illustrated in its assembled condition in FIG. 7, being generally designated 42 therein. As shown in the plan view of FIG. 7, the four pompons 22, due to their fluffy character and the closing movement caused by the projection of the staple 30 firmly into the criss-crossed cores 12, effectively masks the presence of the staple and, as a result, significantly enhances the appearance of the resulting articles of manufacture, particularly insofar as its use as package decoration. Still referring to FIG. 7, it will also be noted that the cardboard substrate 32 is of a selected size so that it is entirely within the confines of the periphery 22*a* of the group of pompons 22, and thus also is not readily discernible in the pompon articles of manufacture 22 hereof when used as package decoration.

Figure 8:
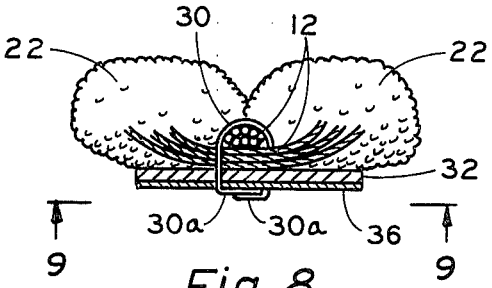
Figure 9:
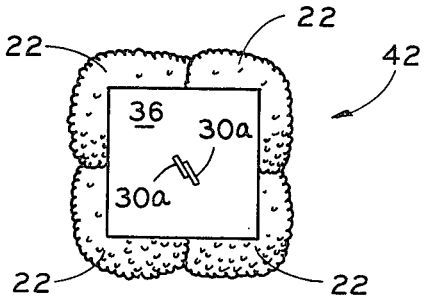

The masking of both the staple 30 and the substrate 32 from view by the pompons 22 is illustrated in the cross-sectional view of FIG. 8. As illustrated in said figure, staple 30 is in place and is projected to a significant extent through the substrate 32 and the depending legs 30*a* thereof bent in engaged relation firmly about the substrate. In this manner staple 30, in a closed loop, is in encircling relation about the criss-crossed yarns which form the two cores 12 which connect the four pompons 22. From the bottom view 9 projected from FIG. 8, it should be readily apparent that the piece 36 of wax paper or the like can be readily removed from its position in covering relation over the adhesive surface 34 of the substrate 33 despite the clenched legs 30*a* of the staple, and thereby provide an exposed adhesive surface 34 for use in attaching the pompon article 42 to a package.

Figure 12:
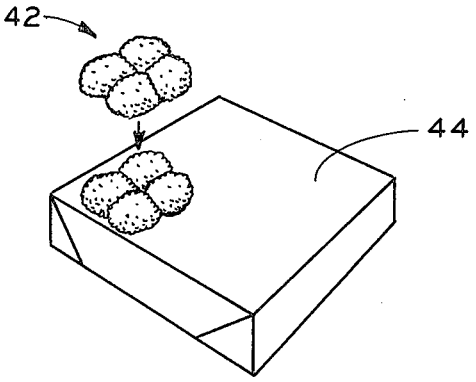

That is, and as illustrated in FIG. 12, once the adhesive surface cover 36 is removed, the pompon articles of manufacture 42 are then readily pressed into adhesive attachment onto a corner or other appropriate location of a gift box 44, thus serving effectively as decoration for the box.

Figure 10:
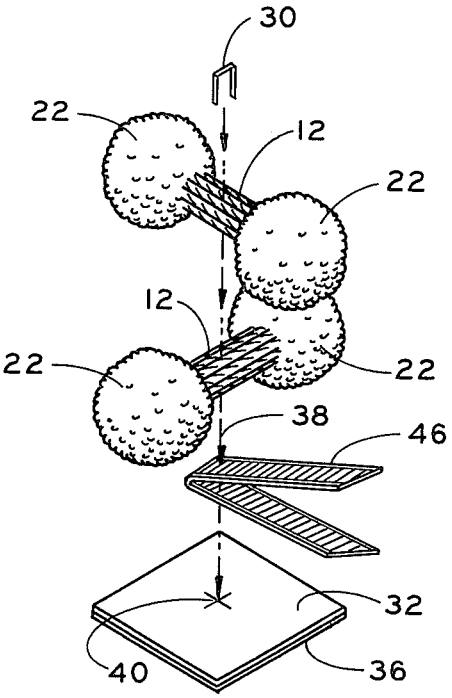
Figure 11:
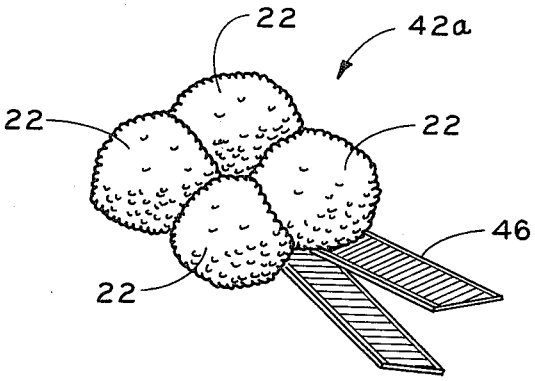

Another contemplated embodiment of a pompon article of manufacture according to the present invention is illustrated in FIGS. 10 and 11, in which structural features already described in connection with FIGS. 6–9 are designated by the same reference numeral and the description thereof will not be repeated both for brevity's sake and as being unnecessary to an understanding of the inventive embodiment of FIGS. 10, 11. What is added is a decorative ribbon 46, folded in two, and placed in an interposed position between the substrate 32 and criss-crossed arrangement of the interconnected pompons 22. As a result, the ribbon 46 is also caught by the staple 30 and effectively held in place with the ends protruding from beneath the pompons 22, all as is clearly illustrated in FIG. 11. The protruding ends of the ribbon 46 contribute to and enhance the appearance in the assembled resulting pompon articles of manufacture 42*a*.

Although not shown, it should be readily apparent that the within invention is not limited to only two interconnected pompons 22, but that three and possibly four such constructions can be placed with the cores 12 thereof in criss-crossed relation and stapled to an adhesively-backed substrate 32. Also, the lengths of yarn 10 can be cotton, synthetic fibers, or combinations thereof. In the aforesaid and other respects, a latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A pompon article of manufacture for package decoration comprising a first operative arrangement of a group of lengths of yarn having a first pair of staples affixed to and spaced one third the length inwardly of the opposite ends thereof to define outwardly of each said staple a pompon and defining between said spaced apart first pair of staples a connecting core for the remaining one third of the length thereof, a second separate similarly constituted operative arrangement of lengths of yarn having a second pair of staples affixed to and spaced one third the length inwardly of the opposite ends thereof to define outwardly of each said staple a pompon and defining between said spaced apart second pair of staples a connecting core for the remaining one third the length thereof, a cooperating operative positioning of said first and second pompons with said connecting cores in a criss-crossed interfitting relation provided by said medial one third length thereof between said pompons, an adhesively-backed substrate for receiving in attached relation thereto said criss-crossed pompons, and a fifth staple disposed in engaged relation about said criss-crossed cores and projected through said substrate incident to achieving said attached relation thereto, whereby said pompons in response to the projection are closed towards each other and cover over said fifth staple and thereby effectively mask said fifth staple from view while the ends of said lengths of yarn beyond said staples of said first and second pairs of staples defining said pompons are fluffed so as to also effectively mask from view said first and second pairs of staples.

2. A pompon articles of manufacture for package decoration as defined in claim 1 including a ribbon in an interposed position between said criss-crossed pompons and substrate for enhancing the appearance thereof.

* * * * *